US006830158B2

(12) United States Patent
Yourist

(10) Patent No.: US 6,830,158 B2
(45) Date of Patent: Dec. 14, 2004

(54) PLASTIC CONTAINER HAVING DEPRESSED GRIP SECTIONS

(75) Inventor: Sheldon Yourist, York, PA (US)

(73) Assignee: Graham Packaging Company, L.P., York, PA (US)

( * ) Notice: Subject to any disclaimer, the term of this patent is extended or adjusted under 35 U.S.C. 154(b) by 0 days.

(21) Appl. No.: 10/294,696

(22) Filed: Nov. 15, 2002

(65) Prior Publication Data

US 2003/0168425 A1 Sep. 11, 2003

Related U.S. Application Data

(63) Continuation-in-part of application No. 29/156,761, filed on Mar. 7, 2002, now Pat. No. Des. 480,310.

(51) Int. Cl.[7] ..... B65D 1/46; B65D 23/10

(52) U.S. Cl. ..... 215/381; 215/382; 215/384; 220/775

(58) Field of Search ..... 215/381, 382, 215/384, 379; 220/606, 669, 671, 675; D9/530

(56) References Cited

U.S. PATENT DOCUMENTS

| | | | | | |
|---|---|---|---|---|---|
| 4,805,788 | A | * | 2/1989 | Akiho | 215/381 |
| D316,968 | S | | 5/1991 | York | |
| D320,154 | S | | 9/1991 | Alberghini et al. | |
| 5,060,453 | A | * | 10/1991 | Alberghini et al. | 53/440 |
| 5,067,622 | A | * | 11/1991 | Garver et al. | 215/381 |
| 5,222,615 | A | * | 6/1993 | Ota et al. | 215/382 |
| 5,224,614 | A | * | 7/1993 | Bono et al. | 215/382 |
| 5,381,910 | A | * | 1/1995 | Sugiura et al. | 215/398 |
| 5,407,086 | A | | 4/1995 | Ota et al. | |
| D378,274 | S | | 3/1997 | Beaver | |
| 5,762,221 | A | | 6/1998 | Tobias et al. | 215/381 |
| D398,538 | S | | 9/1998 | Fuquen et al. | |
| 5,868,272 | A | * | 2/1999 | Deal | 220/669 |
| D417,844 | S | | 12/1999 | Lane | |
| 6,016,932 | A | * | 1/2000 | Gaydosh et al. | 215/382 |
| D420,919 | S | | 2/2000 | Ogg | |
| 6,044,996 | A | * | 4/2000 | Carew et al. | 215/381 |
| 6,044,997 | A | | 4/2000 | Ogg | 215/381 |
| D439,166 | S | * | 3/2001 | Denner et al. | D9/538 |
| 6,213,326 | B1 | * | 4/2001 | Denner et al. | 215/383 |
| D441,660 | S | | 5/2001 | Denner et al. | |
| D445,695 | S | * | 7/2001 | Ogg | D9/550 |
| 6,257,433 | B1 | | 7/2001 | Ogg et al. | 215/381 |
| 6,273,282 | B1 | | 8/2001 | Ogg et al. | 215/381 |
| D462,013 | S | | 8/2002 | Iizuka et al. | |
| D462,271 | S | | 9/2002 | Bourque et al. | |
| 2002/0096486 | A1 | * | 7/2002 | Bourque et al. | |
| 2002/0104820 | A1 | * | 8/2002 | Hong et al. | |

FOREIGN PATENT DOCUMENTS

| | | | | | |
|---|---|---|---|---|---|
| JP | 2000238736 | A | * | 9/2000 | B65D/1/14 |

* cited by examiner

*Primary Examiner*—Sue A. Weaver
(74) *Attorney, Agent, or Firm*—Venable LLP; Stuart I. Smith

(57) ABSTRACT

A blow molded container is provided. The container has a base, a body portion attached to the base, a concave waist attached to the body portion, a dome attached to the waist, and a finish. The dome has a plurality of indented panels arranged around a perimeter of the dome, and the finish has an opening. A portion of the dome is located between the indented panels and the waist.

22 Claims, 3 Drawing Sheets

PLASTIC CONTAINER HAVING DEPRESSED GRIP SECTIONS

This application is a continuation-in-part of U.S. Des. patent application No. 29/156,761 filed Mar. 7, 2002 now U.S. Pat. No. Des. 480,310, which is hereby incorporated by reference in its entirety.

BACKGROUND OF THE INVENTION

1. Field of the Invention

The present invention generally relates to a container, and more particularly to such containers that are typically made of polyester and are capable of being filled with hot liquid. It also relates to an improved dome construction for such containers.

2. Statement of Related Art

"Hot-fill" applications impose significant and complex mechanical stress on the structure of a plastic container due to thermal stress, hydraulic pressure upon filling and immediately after capping the container, and vacuum pressure as the fluid cools.

Thermal stress is applied to the walls of the container upon introduction of hot fluid. The hot fluid causes the container walls to first soften and then shrink unevenly, causing distortion of the container. The plastic material (e.g., polyester) is often, therefore, heat-treated to induce molecular changes resulting in a container that exhibits thermal stability.

Pressure and stress also act upon the sidewalls of a heat resistant container during the filling process and for a significant period of time thereafter. When the container is filled with hot fluid and sealed, the container is subjected to an increased internal pressure. As the liquid and the air headspace under the cap subsequently cools, thermal contraction results in a decrease in pressure in the container. The vacuum created by this cooling tends to mechanically deform the container walls.

Containers for liquid are often shipped in cardboard boxes that are stacked on top of each other during storage and shipping. The containers have exhibited a limited ability to withstand top loading during filling, capping and stacking for transportation. Overcoming these problems is important because it would decrease the likelihood of a container's top or shoulder being crushed, as well as inhibiting ovalization in this area. It is important to be able to stack containers so as to maximize the use of shipping space. Due to the weight of liquid-filled containers, the boxes often need reinforcing such as egg crate dividers to prevent crushing of the containers. The vulnerability of the containers to crushing can be increased by the deformation resulting from the above-mentioned vacuum.

A particular problem which can result from the hot-filling procedure is a decrease in the container's ability to withstand top loading during filling, capping and labeling. Because of the decreased container rigidity immediately after filling and after cooling, even heat set containers are less able to resist loads imparted through the top or upper portion of the container, such as when the containers are stacked one upon the other for storage and shipping. Similar top loads are imparted to the container when it is dropped and lands on the upper portion or mouth of the container. As a result of this top loading, the container can become deformed and undesirable to the consumer.

SUMMARY OF THE INVENTION

Embodiments of the invention provide a container dome structure that helps reduce the container deformation described above. In addition, the invention provides a container dome structure with sufficient topload strength to allow significant reduction in secondary packaging requirements. For example, the need for using "egg crate dividers" may be reduced or eliminated. The invention further provides a container dome structure that improves the handling characteristics such that it is easier for a user to grip the container during use.

Particular embodiments of the invention provide a blow molded container having a base, a body portion attached to the base, a concave waist attached to the body portion, a dome attached to the waist, and a finish. The dome has a plurality of indented panels arranged around a perimeter of the dome, and the finish has an opening. A portion of the dome is located between the indented panels and the waist.

Other embodiments of the invention provide a blow molded container having a base, a body portion attached to the base, a concave waist attached to the body portion, a dome attached to the waist, and a finish attached to the dome. The waist is circular in cross section. The dome has four indented panels evenly spaced around a perimeter of the dome and an upper ledge for providing a user a secure grip on the container. The dome also has four structural ribs, each of the structural ribs being located between two adjacent indented panels. The finish has an opening. A portion of the dome is located between the indented panels and the waist, the portion is circular in cross section and has a larger diameter than the waist. The upper ledge protrudes radially beyond a portion of the dome immediately below the upper ledge, and the upper ledge is adjacent to the indented panels.

Other embodiments of the invention provide a blow molded, hot-fillable container. The container has a base, a body portion attached to the base, a concave waist attached to the body portion, a dome attached to the waist, and a finish attached to the dome. The dome has a plurality of indented panels arranged around a perimeter of the dome, and the finish has an opening. The plurality of indented panels each have a perimeter, the perimeter of each of the indented panels being completely within the dome.

BRIEF DESCRIPTION OF THE DRAWINGS

The foregoing and other features and advantages of the invention will become more apparent from the following detailed description of exemplary embodiments when considered in conjunction with the accompanying drawings, wherein.

DETAILED DESCRIPTION OF THE INVENTION

Figure 1:
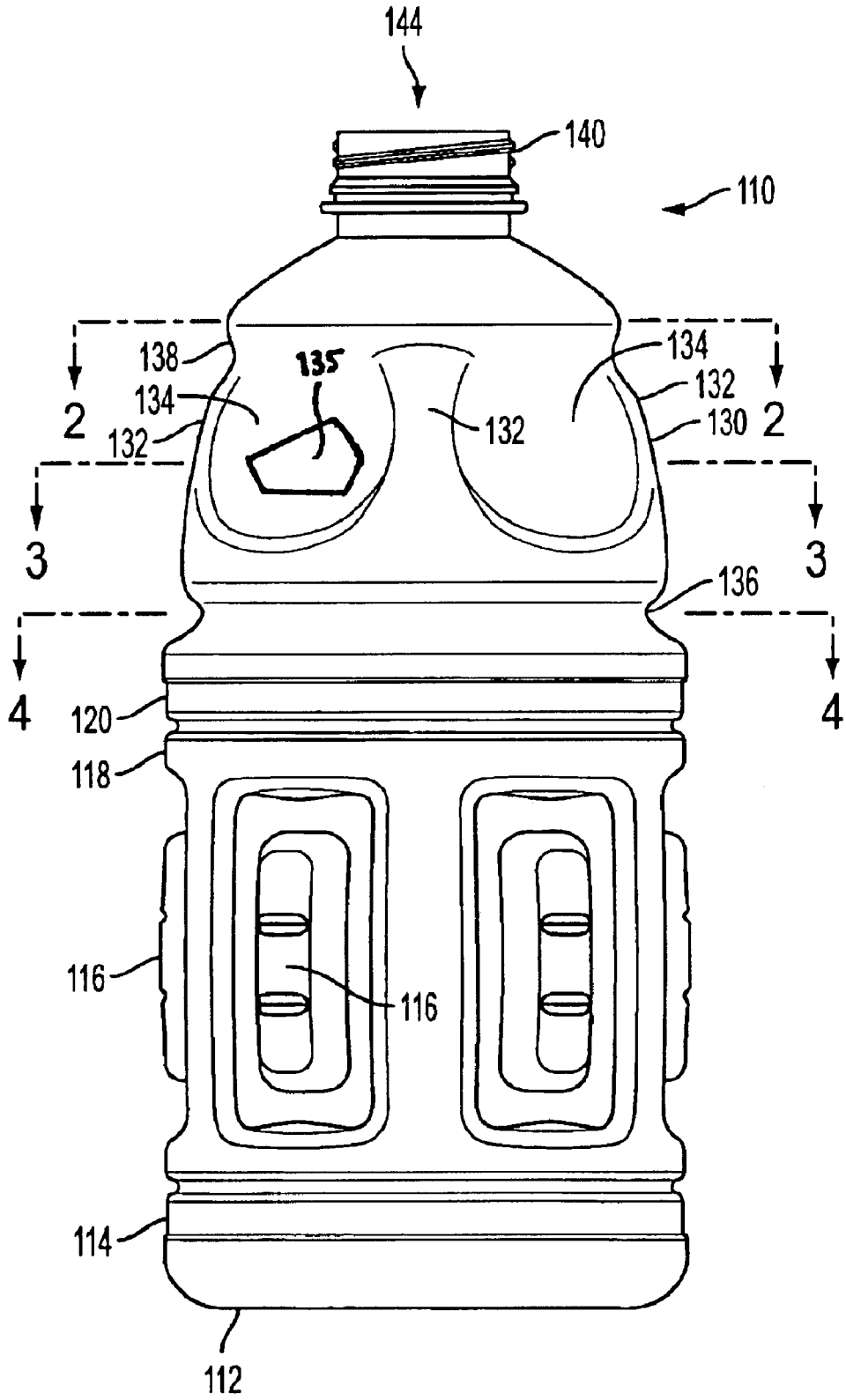
FIG. 1 illustrates a side view of a container according to a first embodiment of the present invention.

Referring now to the drawings, wherein like reference characters or numbers represent like or corresponding parts throughout each of the several views, there is shown in FIG. 1 a blow-molded plastic container 110 having a reinforced dome 130 according to the invention. Dome 130 is designed to provide an aesthetically pleasing package and to provide griping surfaces on container 110 as well as improved control of dome distortion caused by top-loading. Container 110 is an example of a container used to package liquids, such as, for example, beverages. However, container 110 can also be used to contain powders or other flowing materials. A specific example of a use of container 110 is to contain 32 oz. of a hot-fillable juice.

Attached to dome 130 is a finish 140 having an opening 144. In some embodiments, finish 140 is threaded to receive a threaded cap. Attached to dome 130 at an end opposite finish 140 is a waist 136. Waist 136 generally has a smaller cross-sectional area than does a lower portion of dome 130. Below waist 136 is an upper label bumper 120. Upper label bumper 120 and a lower label bumper 114 are boundaries for a label mounting area 118. Upper label bumper 120, label mounting area 118 and lower label bumper 114 provides surfaces for a label to be affixed with, for example, glue to container 110. In this example, flexible panels 116 are provided within label mounting area 118 to provide strength and/or to accommodate volumetric changes to a hot-fill container after it has been sealed and as it cools. A base 112 is provided at the bottom of container 110.

The embodiment of dome 130 shown in FIG. 1 has a larger cross-sectional area at its lower extremity than does the smallest portion of waist 136. In this example, dome 130 has its maximum cross-sectional area at this lowest point. Also, dome 130 is generally circular in cross section, with the diameter of the cross section becoming smaller as the distance from waist 136 increases. This reduction in diameter produces an inwardly sloping dome as one moves toward finish 140. However, an upper ledge 138 is provided at a particular point on dome 130. In this example, upper ledge 138 is provided at a distance from waist 136 that is approximately two-thirds of the difference from waist 136 to finish 140. However, the vertical location of upper ledge 138 can be modified as strength requirements, aesthetic considerations and user handling considerations dictate.

In the highly competitive market for improved liquid containers, improvements in container design that result in a container that is more easily handled by the user can be very beneficial. A typical blow-molded container contains 32 oz. of liquid. As such, the container can be heavy and awkward to handle when full. The embodiment of the invention shown in FIG. 1 has a plurality, in this example four, indented panels 134. Indented panels 134 provide surfaces that facilitate gripping container 110 between a user's thumb and fingers. Indented panels 134 can also act as vacuum stress relievers that can flex inward to remove a portion of the vacuum stress on the total package. In this example, indented panels 134 are substantially round.

The four equally spaced indented panels 134 of the example shown in FIG. 1 result in each panel 134 being opposite, 180° from, another indented panel 134. In this embodiment, it is particularly easy to grip container 110 between the thumb and fingers of one hand. Although this example has four equally spaced indented panels 134, it is noted that any other number of indented panels or unequally spaced indented panels can also be used. The plurality of indented panels 134 are separated in this example by a structural rib 132 between each pair of adjacent indented panels 134. Structural ribs 132, in this example, extend in an axial direction of container 110. Structural ribs 132 provide increased rigidity to container 110 that can make container 110 sufficiently strong to support the weight of multiple similar filled containers. This strength is valuable as it can allow the shipping of a plurality of containers in boxes with a reduced amount of secondary packaging such as, for example, egg crate dividers while still permitting multiple boxes to be stacked on each other. The invention balances the marketing benefits of an aesthetically pleasing product with the benefits of added strength to produce a commercially superior container. The additional feature of providing surfaces suitable for placement of company logos, etc., adds to the invention's commercial superiority.

In addition to the indented panels 134, upper ledge 138 facilitates handling of the container by providing surfaces against which a user's thumb and fingers can press.

In addition to the benefits discussed above, indented panels 134 provide surfaces for product logos or other graphics. The logos or graphics can be incorporated into the mold for the container, resulting in indented panels 134 being embossed with the logo or graphic. An example of such a graphic is labeled in FIG. 1 with reference number 135.

Figure 2:
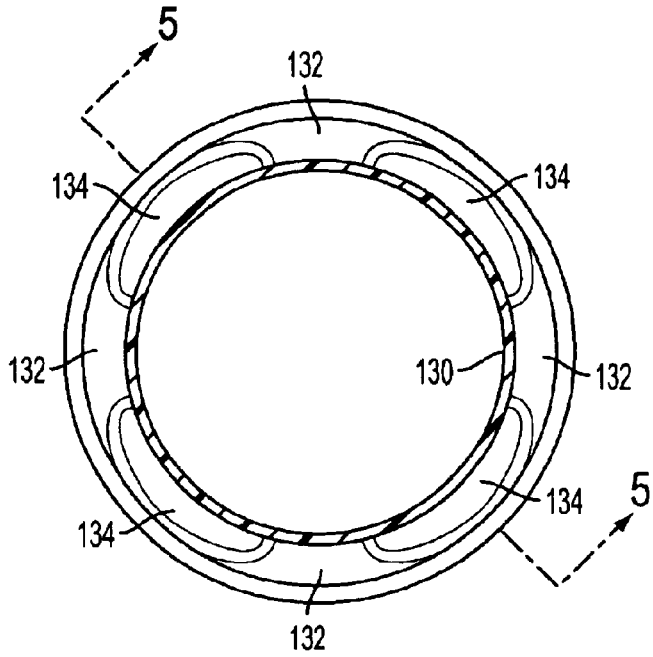
FIG. 2 illustrates a sectional view along section line 2—2 of the container shown in FIG. 1.
Figure 3:
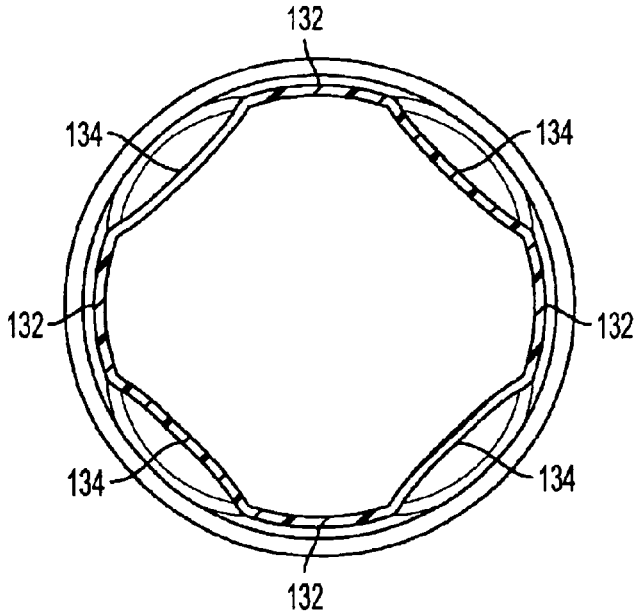
FIG. 3 illustrates a sectional view along section line 3—3 of the container shown in FIG. 1.
Figure 4:
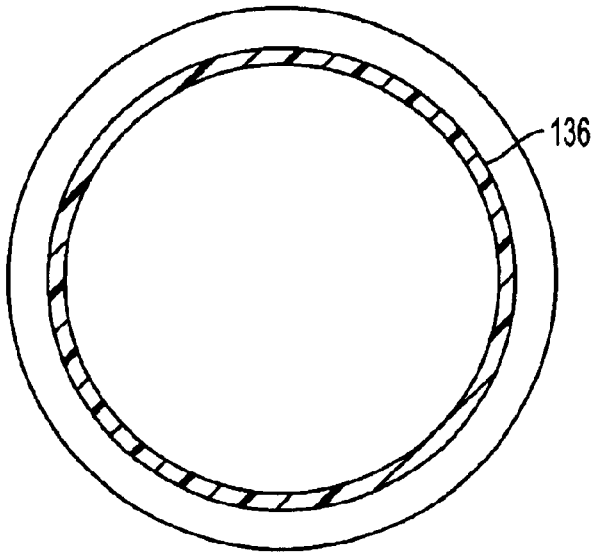
FIG. 4 illustrates a sectional view along section line 4—4 of the container shown in FIG. 1.

FIGS. 2-4 show cross sections through container 110. FIG. 2 shows a cross section through upper ledge 138. In this example, the cross section of upper ledge 138 is circular. However, other cross-sectional shapes, such as, for example, oval or substantially rectangular, can be used. FIG. 3 shows a cross section through indented panels 134 and structural ribs 132. FIG. 3 shows that, in this example, the cross section of dome 130 is substantially circular except for indented panels 134. Other shapes such as, for example, oval and substantially rectangular, can be used. In the example shown, the corners between each indented panel 134 and the adjacent structural ribs 132 provide strength along the longitudinal axis of the container. This strength aids in providing the container with sufficient longitudinal strength to support stacking of multiple containers. This feature helps reduce the costs associated with shipping and storage by eliminating or reducing the need for reinforcement inside boxes used to ship the containers. FIG. 4 shows a cross section through waist 136. In this example, waist 136 has a circular cross section. However, other cross-sectional shapes, such as, for example, oval or substantially rectangular, can be used.

Figure 5:
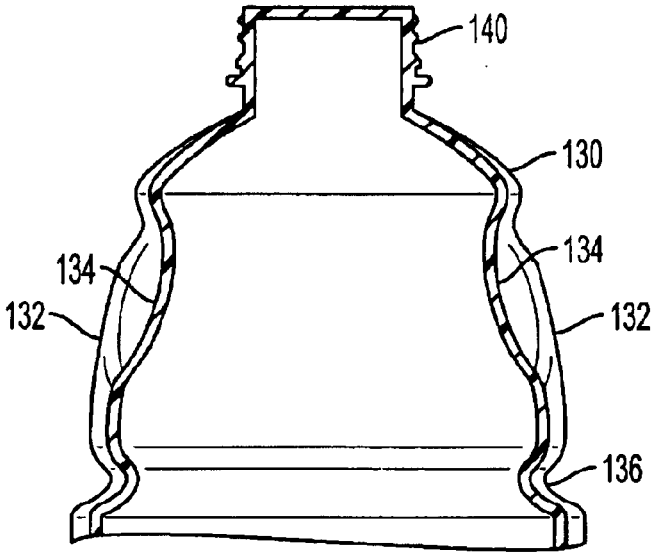
FIG. 5 illustrates a sectional view along section line 5—5 of the container shown in FIGS. 1 and 2.

FIG. 5 shows a vertical section through finish 140, dome 130 and waist 136.

The container of the present invention may comprise any material known in the art and generally used for the described applications as well as others. These materials include plastics, for example, polyethylene terephthalate (PET), low density polyethylene (LDPE), high density polyethylene (HDPE), and nylons, as well as other polyesters, polyolefins, polycarboxyamides, and polycarbonates having suitable properties for the intended application. The bottles can be manufactured from resilient and pliable plastic materials so that they are squeezable.

As shown by the examples of the invention described herein and illustrated in the drawings, the invention provides a container having beneficial handling characteristics and strength.

Although particular embodiments of the invention are shown and described, it is noted that other embodiments of the invention will be apparent to those skilled in the art to which the invention pertains upon review of this disclosure. These and other embodiments are considered to be in the spirit of, and part of, the invention.

What is claimed is:

1. A blow molded container, comprising:

a base;

a body portion attached to the base;

a concave waist attached to the body portion, the waist being circular in cross-section;

a dome attached to the waist, the dome having a plurality of indented panels arranged around a perimeter of the dome; and a finish attached to the dome, the finish having an opening, wherein a portion of the dome is located between the indented panels and the waist, the dome further comprises an upper ledge for providing a user a secure grip on the container, the upper ledge protrudes radially beyond a portion of the dome immediately below the upper ledge, and the upper ledge is adjacent to the indented panels.

2. A blow molded container, comprising:

a base;

a body portion attached to the base;

a concave waist attached to the body portion;

a dome attached to the waist, the dome having a plurality of indented panels arranged around a perimeter of the dome; and a finish attached to the dome, the finish having an opening, wherein a portion of the dome is located between the indented panels and the waist, and the dome further comprises an upper ledge for providing a user a secure grip on the container, the upper ledge protrudes radially beyond a portion of the dome immediately below the upper ledge, and the upper ledge is adjacent to the indented panels.

3. The container of claim 2, wherein the portion of the dome located between the indented panels and the waist is circular in cross section and has a larger diameter than the waist.

4. The container of claim 2, wherein the dome has four indented panels.

5. The container of claim 4, further comprising four structural ribs, each of the structural ribs being located between two adjacent indented panels.

6. The container of claim 5, wherein the structural ribs are substantially vertical.

7. The container of claim 4, wherein the four indented panels are spaced uniformly around the dome.

8. The container of claim 7, wherein the indented panels are substantially round.

9. The container of claim 2, wherein at least one of the indented panels has a graphic embossed in a surface of the indented panel.

10. The container of claim 2, wherein the indented panels are flexible such that they flex inward to remove a portion of a vacuum stress on the container.

11. A blow molded container, comprising:

a base;

a body portion attached to the base;

a concave waist attached to the body portion, the waist being circular in cross section;

a dome attached to the waist, the dome having four indented panels evenly spaced around a perimeter of the dome and an upper ledge for providing a user a secure grip on the container;

four structural ribs, each of the structural ribs being located between two adjacent indented panels; and a finish attached to the dome, the finish having an opening, wherein a portion of the dome is located between the indented panels and the waist, the portion of the dome located between the indented panels and the waist is circular in cross section and has a larger diameter than the waist, the upper ledge protrudes radially beyond a portion of the dome immediately below the upper ledge, and the upper ledge is adjacent to the indented panels.

12. A blow molded, hot-fillable container, comprising:

a base;

a body portion attached to the base;

a concave waist attached to the body portion, the waist being circular in cross-section;

a dome attached to the waist, the dome having a plurality of indented panels arranged around a perimeter of the dome; and a finish attached to the dome, the finish having an opening, wherein the plurality of indented panels each have a perimeter, the perimeter of each of the indented panels being completely within the domes, the dome further comprises an upper ledge for providing a user a secure grip on the container, the upper ledge protrudes radially beyond a portion of the dome immediately below the upper ledge, and the upper ledge is adjacent to the indented panels.

13. A blow molded, hot-fillable container, comprising:

a base;

a body portion attached to the base;

a concave waist attached to the body portion;

a dome attached to the waist, the dome having a plurality of indented panels arranged around a perimeter of the dome; and a finish attached to the dome, the finish having an opening, wherein the plurality of indented panels each have a perimeter, the perimeter of each of the indented panels being completely within the dome, the dome further comprises an upper ledge for providing a user a secure grip on the container, the upper ledge protrudes radially beyond a portion of the dome immediately below the upper ledge, and the upper ledge is adjacent to the indented panels.

14. The container of claim 13, wherein the dome has four indented panels.

15. The container of claim 14, further comprising four structural ribs, each of the structural ribs being located between two adjacent indented panels.

16. The container of claim 15, wherein the structural ribs are substantially vertical.

17. The container of claim 14, wherein the four indented panels are spaced uniformly around the dome.

18. The container of claim 17, wherein the indented panels are substantially round.

19. The container of claim 13, wherein at least one of the indented panels has a graphic embossed in a surface of the indented panel.

20. The container of claim 13, wherein the indented panels are flexible such that they flex inward to remove a portion of a vacuum stress on the container.

21. A blow molded container, comprising:

a base;

a body portion attached to the base;

a concave waist attached to the body portion;

a dome attached to the waist, the dome having a plurality of indented panels arranged around a perimeter of the dome, the indented panels being substantially round; and a finish attached to the dome, the finish having an opening, wherein a portion of the dome is located between the indented panels and the waist, the dome further comprises an upper ledge for providing a user a secure grin on the container, the upper ledge protrudes radially beyond a portion of the dome immediately below the upper ledge, and the upper ledge is adjacent to the indented panels.

22. A blow molded, hot-fillable container, comprising:

a base;

a body portion attached to the base;

a concave waist attached to the body portion;

a dome attached to the waist, the dome having a plurality of indented panels arranged around a perimeter of the dome, the indented panels being substantially round; and a finish attached to the dome, the finish having an opening, wherein the plurality of indented panels each have a perimeter, the perimeter of each of the indented panels being completely within the dome, the dome further comprises an upper ledge for providing a user a secure grip on the container, the upper ledge protrudes radially beyond a portion of the dome immediately below the upper ledge, and the upper ledge is adjacent to the indented panels.

* * * * *